US005882251A

United States Patent [19]

Berman et al.

[11] Patent Number: 5,882,251

[45] Date of Patent: Mar. 16, 1999

[54] CHEMICAL MECHANICAL POLISHING PAD SLURRY DISTRIBUTION GROOVES

[75] Inventors: Michael J. Berman; Jayashree Kalpathy-Cramer, both of West Linn, Oreg.

[73] Assignee: LSI Logic Corporation, Milpitas, Calif.

[21] Appl. No.: 914,854

[22] Filed: Aug. 19, 1997

[51] Int. Cl.[6] ..... B24B 1/00

[52] U.S. Cl. ..... 451/527; 451/285; 451/528; 451/287; 451/533

[58] Field of Search ..... 451/41, 285, 287, 451/288, 526, 527, 533, 539, 528, 529

[56] References Cited

U.S. PATENT DOCUMENTS

| | | | |
|---|---|---|---|
| 5,081,051 | 1/1992 | Mattingly et al. . | |
| 5,216,843 | 6/1993 | Breivogel et al. . | |
| 5,527,215 | 6/1996 | Rubino et al. | 451/527 |
| 5,536,202 | 7/1996 | Appel et al. . | |
| 5,547,417 | 8/1996 | Breivogel et al. . | |
| 5,609,517 | 3/1997 | Lofaro | 451/529 |
| 5,645,469 | 7/1997 | Burke et al. | 451/527 |
| 5,664,989 | 9/1997 | Nakata et al. | 451/41 |
| 5,807,165 | 9/1998 | Uzoh et al. | 451/41 |

OTHER PUBLICATIONS

Unknown Author, "About Bridgeport Machines", *Company Information,* http://www/bpt.com.

*Primary Examiner*—Eileen P. Morgan
*Attorney, Agent, or Firm*—Beyer & Weaver, LLP

[57] ABSTRACT

Provided is a chemical mechanical polishing pad having grooves in its polishing surface which have a sub-surface cross-sectional span greater than the grooves' surface opening span. In this way, the edges of the groove are undercut. This provides both increased groove volume for a given pad surface area and groove depth, and variable flexibility in the polishing pad's surface. Grooves in pads of the invention also typically include a neck region at the top of the groove, where the groove side walls are substantially parallel. This provides a margin for the pad to wear during polishing without affecting the pad's surface area. The invention also provides a method and apparatus for cutting grooves in a chemical mechanical polishing pad.

12 Claims, 9 Drawing Sheets

CHEMICAL MECHANICAL POLISHING PAD SLURRY DISTRIBUTION GROOVES

BACKGROUND OF THE INVENTION

The present invention relates to slurry distribution grooves in a polishing pad employed in chemical mechanical polishing (CMP). More particularly, the present invention relates to cross-sectional groove shapes which increase the slurry carrying capacity of a polishing pad and improve the pad's surface hardness characteristics.

Chemical mechanical polishing (sometimes referred to as "CMP") typically involves mounting a semiconductor wafer faced down on a holder and rotating the wafer face against a polishing pad mounted on a platen, which in turn is rotating or moving linearly or orbitally. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to planarize various wafer layers such as dielectric layers, metallization layers, etc.

FIG. 1 shows some major components of a chemical mechanical polishing (CMP) apparatus such as an Avant-Gaard 676, commercially available from Integrated Processing Equipment Corporation (IPEC) of Phoenix, Ariz. CMP apparatus 100 includes a wafer carrier 128 that is fitted with an air chamber 126 (shown in phantom lines), which is designed to secure a wafer 124 by vacuum to wafer carrier 128 during wafer loading typically before CMP is to commence. During CMP, however, wafer 124 is bound by "wear rings" (not shown to simplify illustration) within wafer carrier 128 such that a wafer surface that is to be polished contacts a polishing pad 102.

A conventional polishing pad 102 includes a plurality of slurry injection holes 120, and adheres to a flexible pad backing 104 which includes a plurality of pad backing holes 118 aligned with the slurry injection holes 120. A slurry mesh 106, typically in the form of a screen-like structure, is positioned below the pad backing 104. An air bladder 108 capable of inflating or deflating is disposed between a plumbing reservoir 110 and the slurry mesh 106. A co-axial shaft 112, through which a slurry inlet 114 (shown by phantom lines) is provided to deliver slurry through the plumbing reservoir 110 and the air bladder 108 to the slurry mesh 106, is attached to the bottom of plumbing reservoir 110. In this configuration, a slurry flow path is defined by the slurry entering through slurry inlet 114, spreading out through the slurry mesh 106 below the pad backing 104, entering pad backing holes 118 and exiting through slurry injection holes 120 on the surface of polishing pad 102.

A CMP pad is typically provided with grooves in its polishing surface for slurry distribution and improved pad-wafer contact. These grooves are of two types, either or both of which may be present on a conventional pad's polishing surface. The smaller of the two groove types, sometimes referred to as "microgrooves," are typically about 10 mils wide and 10 mils deep. Microgrooves increase the pad roughness and thereby facilitate the polishing process by creating point contacts and providing space for a small amount of slurry at the wafer-pad surface interface during CMP. Larger or "macrogrooves" (also referred to as slurry distribution grooves) increase the amount of slurry that may be applied to the polishing pad surface per unit area, and thereby increase CMP efficiency. Conventional macrogrooves are typically about 50 mils deep by 50 mils wide.

FIG. 2 shows a top view of a conventional polishing pad 102, such as used with the CMP apparatus shown in FIG. 1.

An example of such a pad is the IC 1000, commercially available from Rodel Inc., Newark, Del. Polishing pads may be made of materials including, for example, urethane, polyurethane, felt, polymer and a filler material. Polishing pad 102 includes macrogrooves (slurry distribution grooves) 130, which are shown in an X-Y configuration, and microgrooves 132 which oriented diagonally relative to macrogrooves 130. At various intersections of grooves 130 in the X direction and grooves 130 in the Y direction, slurry injection holes 120 are provided.

In conventional chemical mechanical polishing pads, slurry distribution grooves in the polishing pad surface have substantially parallel side walls. Cross-sectional views of such conventional groove shapes are shown in FIGS. 3A–3C. In FIG. 3A, groove 300 has substantially parallel side walls 302, 304 extending down from the polishing pad surface 306 to the pointed base of the groove 308. The span 310 of the surface opening 312 of the groove 300 is substantially the same as the maximum sub-surface span 314 of the groove 300.

FIGS. 3B and 3C show alternative conventional groove cross-sections 320 and 330, respectively, having flat and rounded bases 322 and 332, respectively. As with groove 300, grooves 320 and 330 have surface opening spans 310 substantially the same as their maximum sub-surface spans 314.

Conventional chemical mechanical polishing pad slurry distribution grooves such as those illustrated in FIGS. 3A–3C are typically formed by incising cuts in the polishing surface of a chemical mechanical planarization polishing pad. Common apparatuses for making these cuts include saws, mills, and lathes. The substantially parallel side walls 302 and 304 of these conventionally shaped grooves are generally a function of the profile of the cutting blade which forms them.

A CMP pad will have a surface hardness largely determined by the material from which it is formed and any structural alterations made to the pad surface. While conventional groove patterns may provide some regional flexibility beyond that normally characteristic of a particular pad material, conventional pads have substantially uniform hardness across their surfaces. This uniformity may result in the formation of pits in the surface of a polished wafer, adjacent to bumps removed during CMP, due to the inability of the pad to conform somewhat to the wafer topography. Such pit formation detracts from the quality of the planarization of the wafer surface that may be achieved by CMP.

Thus, while conventional slurry distribution grooves increase the slurry carrying capacity of CMP pads, a CMP pad with a groove design that improved slurry carrying capacity over conventional designs and thus improved CMP efficiency, would be desirable. Additionally, a pad having a hardness optimized to reduce bumps in a wafer surface while minimizing the development of pits during polishing is needed.

SUMMARY OF THE INVENTION

To achieve the foregoing, the present invention provides a chemical mechanical polishing pad having grooves in its polishing surface which have a sub-surface cross-sectional span greater than the grooves' surface opening span. In this way, the edges of the groove are undercut. This provides both increased groove volume for a given pad surface area and groove depth, and variable flexibility in the polishing pad's surface.

Grooves according to the present invention may have a variety of shapes consistent with a sub-surface cross-sectional span of the groove being greater than the grooves' surface opening span. Grooves in pads of the invention also typically include a neck region at the top of the groove, where the groove side walls are substantially parallel. This provides a margin for the pad to wear during polishing without affecting the pad's surface area.

The invention also provides a method of cutting grooves in a chemical mechanical polishing pad. The method includes providing a chemical mechanical polishing pad blank having a polishing surface. The pad blank's polishing surface is contacted with a cutter, and a groove is cut in the polishing surface of the pad blank. The groove has a cross-sectional subsurface span greater than the groove's surface opening span. The groove also typically includes a neck region at the top of the groove, where the groove side walls are substantially parallel. The method may be implemented many different ways using apparatuses known in the art. For example, the grooves may be formed by making a plurality of differently angled cuts in the polishing surface of a CMP pad blank using a saw-type or mill-type apparatus.

The invention further provides a device for cutting grooves in a chemical mechanical polishing pad. The device has a shank and a rotary cutting head which has a cross-sectional profile of a desired groove cross-section attached to the shank. The cutting head includes one or more blades and is capable of cutting grooves in a chemical mechanical polishing pad polishing surface when rotating. The device of the present invention may be implemented on a router-type cutting apparatus.

These and other features and advantages of the present invention are described below with reference to the drawings.

DETAILED DESCRIPTION OF THE PREFERRED EMBODIMENTS

The present invention provides cross-sectional groove shapes which increase the slurry carrying capacity of a chemical mechanical polishing pad and improve the pad's surface hardness characteristics. In the following description, numerous specific details are set forth in order to fully illustrate preferred embodiments of the present invention. It will be apparent, however, that the present invention may be practiced without limitation to some specific details presented herein.

In the preferred embodiments of the present invention described herein, feature dimensions are provided for a standard ten inch diameter CMP pad. One of ordinary skill in the art will recognize, however, that the inventive groove patterns may be scaled up or down regardless of pad diameter.

Figure 1:
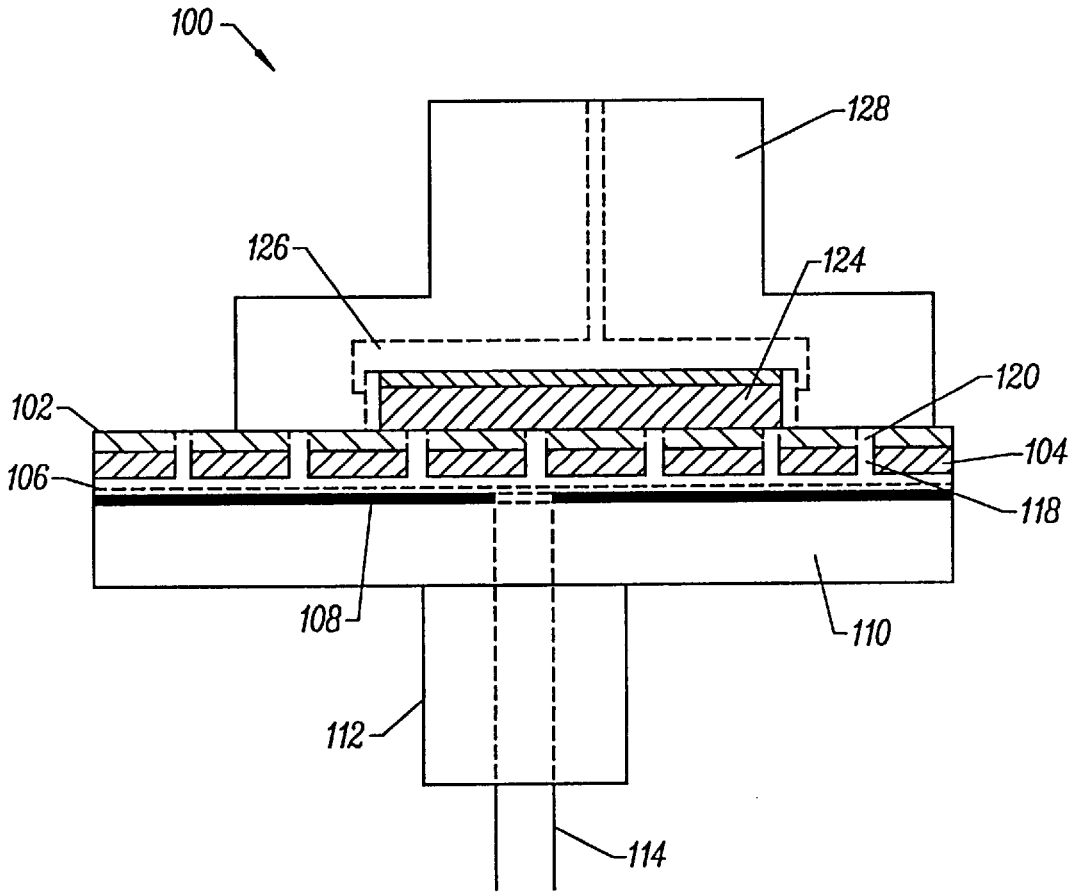
FIG. 1 depicts a cross-sectional view of a typical chemical mechanical polishing apparatus.
Figure 2:
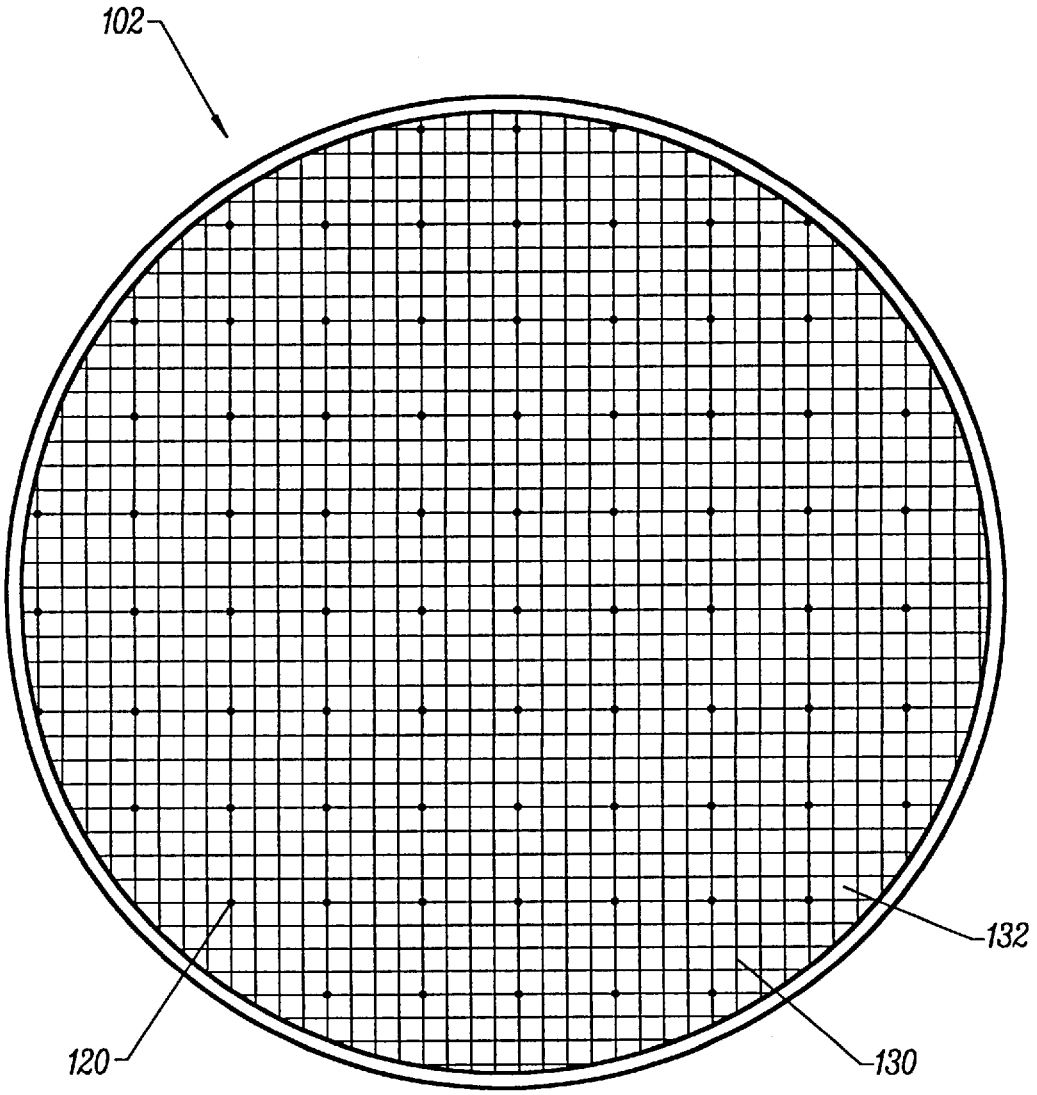
FIG. 2 depicts a top view of a chemical mechanical polishing pad with slurry distribution grooves arranged in a grid pattern on the pad's polishing surface.
Figure 3A:
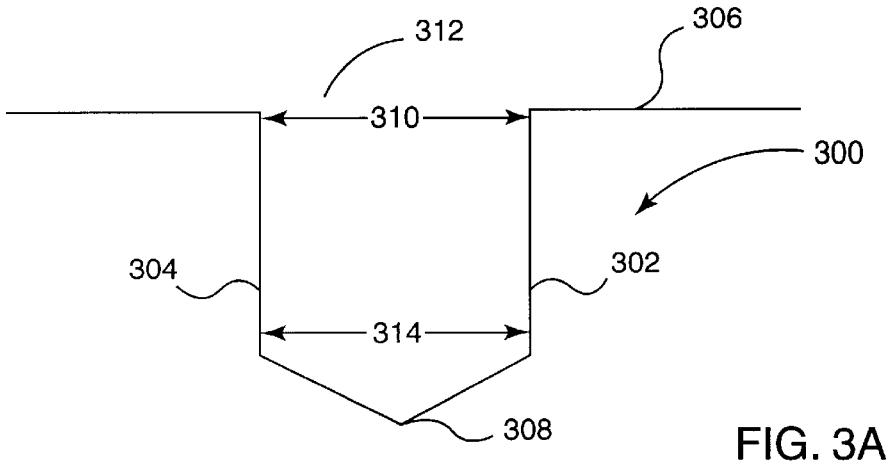
FIGS. 3A–C depict cross-sectional views of conventional chemical mechanical polishing pad slurry distribution grooves.
Figure 3B:
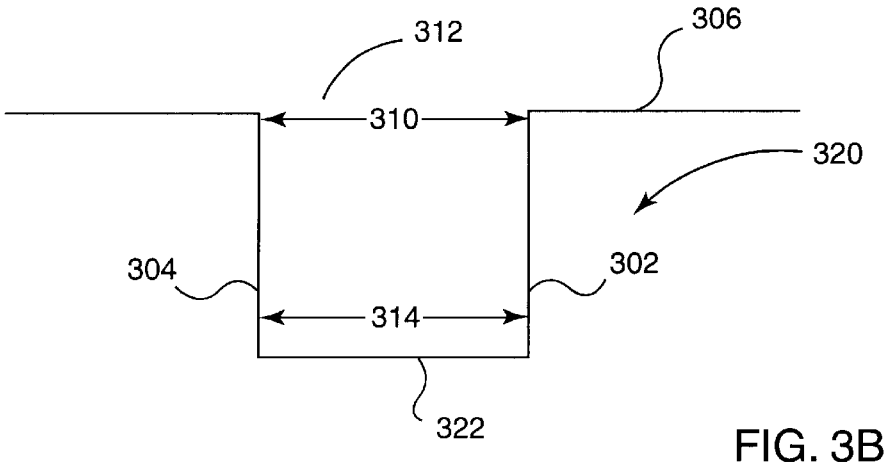
Figure 3C:
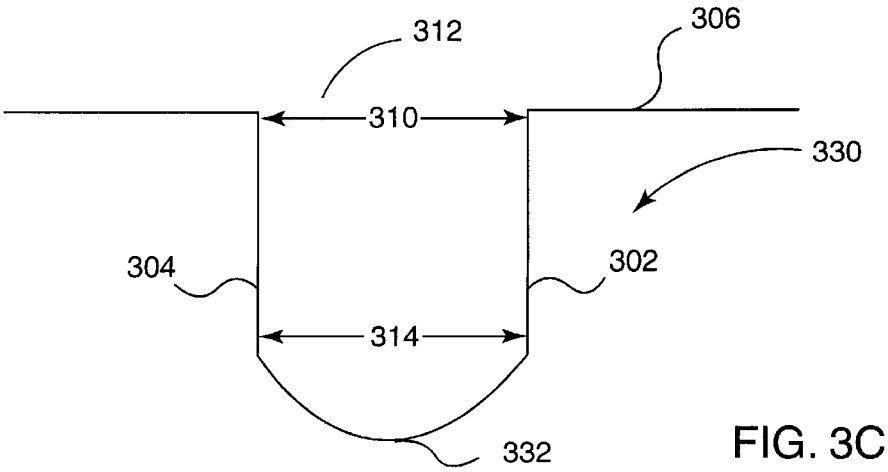
Figure 4A:
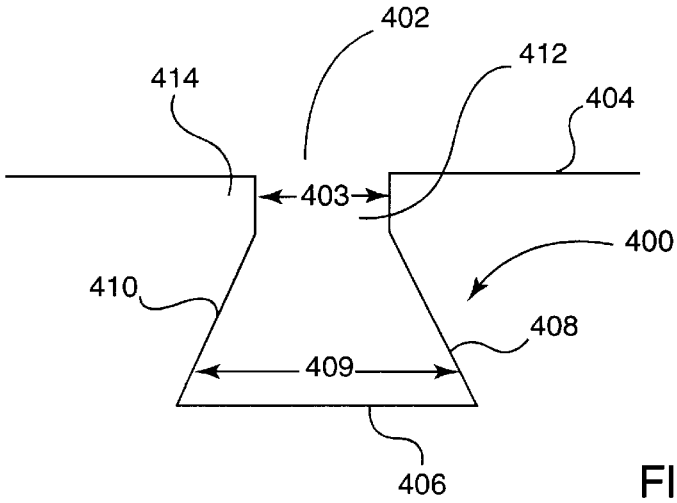
FIGS. 4A–F depict cross-sectional views of various slurry distribution grooves for chemical mechanical polishing pads in accordance with preferred embodiments of the present invention.

FIG. 4A shows a cross-sectional view of a groove in the polishing surface of a CMP pad in accordance with one embodiment of the present invention. The groove 400 has a surface opening 402 at the CMP pad's polishing surface 404. The span of this opening is preferably about 5 to 60 mils, more preferably about 30 to 50 mils, and most preferably about 40 mils. The groove also has side walls 408 and 410 which are substantially parallel for a short distance, for example about 5 to 20 mils, below the surface opening 402 before diverging towards the groove's base 406. The side walls may be angled preferably at about 5 to 80 degrees, more preferably about 10 to 45 degrees, most preferably about 30 degrees positively from normal to the polishing surface. The depth of the groove 400 is preferably about 10 to 60 mils, more preferably about 30 to 50 mils, and most preferably about 40 mils. The divergence of the side walls 408 and 410 in the lower portion of the groove leaves a neck 412 adjacent to the groove's surface opening 402.

It should be noted that groove 400 has a sub-surface cross-sectional span 409 which is greater than the span 403 of the surface opening 402. In the embodiment depicted in FIG. 4A the maximum span of groove 400 is at its base 406. This maximum span is preferably about 10 to 100 mils, more preferably about 20 to 80 mils, and most preferably about 60 mils.

While many groove cross-sectional shapes come within the scope of the present invention, an important features common to all is that they have a sub-surface cross-sectional span greater than their surface opening span. This characteristic provides two important advantages over prior art CMP pad groove shapes. The inventive groove shape increases the slurry carrying capacity of the polishing pad for a given polishing pad surface area and groove depth by increasing groove volume relative to conventional grooves cut with parallel side walls. The increased sub-surface volume of the grooves makes it possible for the polishing pad to carry more slurry which is then available to contact the wafer surface and thereby improve the effectiveness of the CMP.

A second advantage of the CMP pads with grooves in accordance with the present invention is that the portion of the polishing pad surface adjacent to the necks of the grooves, being slightly undercut, are more flexible than other regions on the polishing surface. As a result, a pad with grooves cut in accordance with the present invention will have regions of varying flexibility across its polishing surface. This variable flexibility is a particularly beneficial characteristic since it allows a polishing pad to combine the benefits of being composed of a relatively hard material without the drawbacks of a uniform hardness. Bumps (protrusions above the majority of the wafer surface) are best removed with a relatively hard polishing pad which will grind down the bump until its more planar with the majority of the wafer surface. However, a uniformly hard material will be deformed by contact with a bump in such a way that it polishes depressions, or dips, into areas adjacent to the bump on the wafer surface. The variable hardness of a CMP pad in accordance with the present invention allows the hard pad to flex around bumps so that it may efficiently remove bumps without forming dips.

It should also be noted that the groove necks, in addition to providing flexibility relative to adjacent areas on the polishing pad, also provide a margin for the pad to wear during CMP without affecting its surface area. In this way, polishing conditions may be kept as uniform as possible as the pad wears.

CMP pads with grooves according to the present invention may be composed of conventional pad materials including, for example, urethane, polyurethane, felt, polymer and a filler material. The pads may be adapted for use with any CMP system, including through pad slurry injection CMP systems, such as the AvantGaard 676, commercially available from Integrated Processing Equipment Corporation (IPEC) of Phoenix, Ariz., as described above. Pads according to the present invention may also be used with CMP systems which apply slurry to the pad surface directly from a source disposed above the pad, such as the IPEC AvantGaard 472.

Figure 4B:
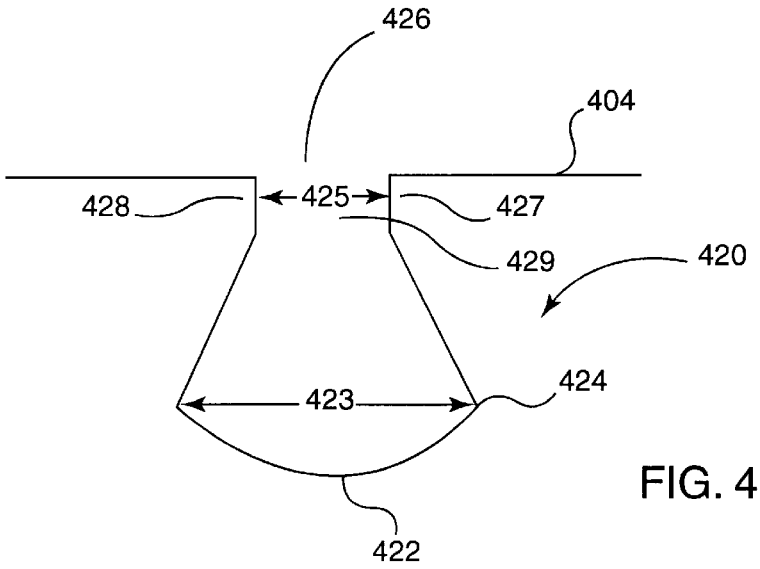

FIGS. 4B–4F depict cross-sections of various alternative polishing pad groove shapes in accordance with the present invention. FIG. 4B shows a groove 420 having a generally triangular shape as in the groove shown in FIG. 4A, but with a curved base 422. The maximum span 423 of groove 420 is at the rim 424 of base 422. This span 423 is greater than the span 425 of the groove surface opening 426. As with the embodiment depicted in FIG. 4A, groove 420 includes neck 429 with edges 427 and 428 which are flexible relative to adjacent areas on the polishing pad, and provide a margin for the pad to wear without affecting its surface area. Feature dimensions provided for the preferred embodiment of FIG. 4A are applicable to this and the other alternative embodiments depicted and described herein.

Figure 4C:
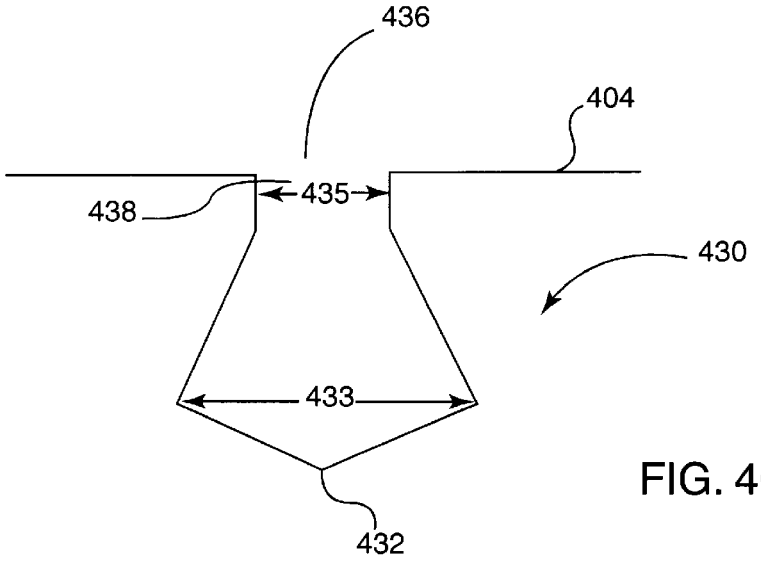

FIG. 4C depicts a cross-section of another alternative groove shape in accordance with the present invention. The groove 430 may be characterized as being of "diamond" shape, having a pointed base 432. Its maximum span 433 is at a point between the base and the polishing pad surface 404. The maximum span 433 is greater than the span 435 of the surface opening 436. A groove according to the present invention having a diamond shape such as depicted in FIG. 4C may not necessarily have a larger volume than a conventionally cut groove having a surface opening of the same span and the same depth. However, such a groove shape will have the benefit of relatively flexible groove neck edges 437 and 438, and thus provide a CMP pad with a polishing surface having regions of variable hardness.

Figure 4D:
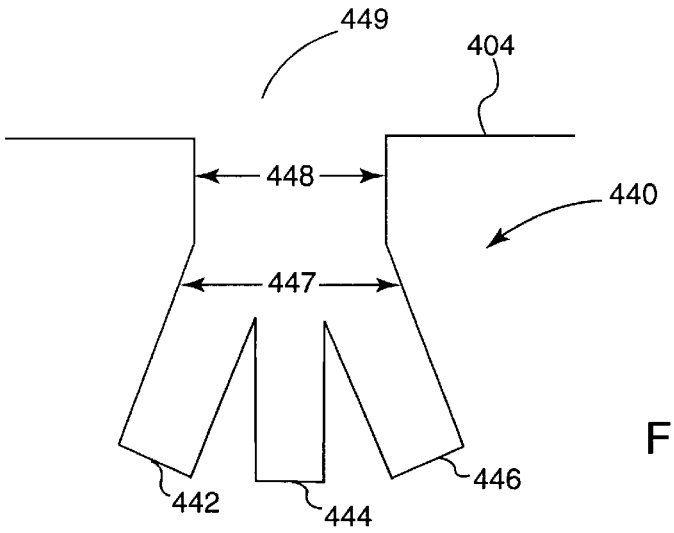
Figure 4E:
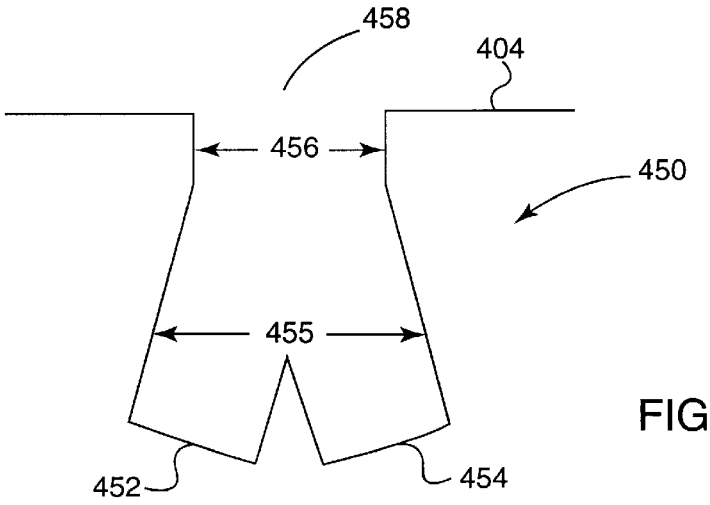

FIG. 4D depicts cross-sectional view of yet another alternative groove shape for a CMP pad according to the present invention. Groove 440 has a complex "multi-leg" shape resulting from the method by which it is cut in the polishing pad surface. Groove 440 has three leg sections 442, 444, and 446, each of which represent a separate cut made in the polishing pad to form the groove. The maximum span 447 of groove 440 is greater than the span 448 of the surface opening 449. Similarly, FIG. 4E shows a groove 450 cut in two separate leg sections 452 and 454, and having a maximum span 455 greater than the surface of the span 456 of the surface opening 458.

Figure 4F:
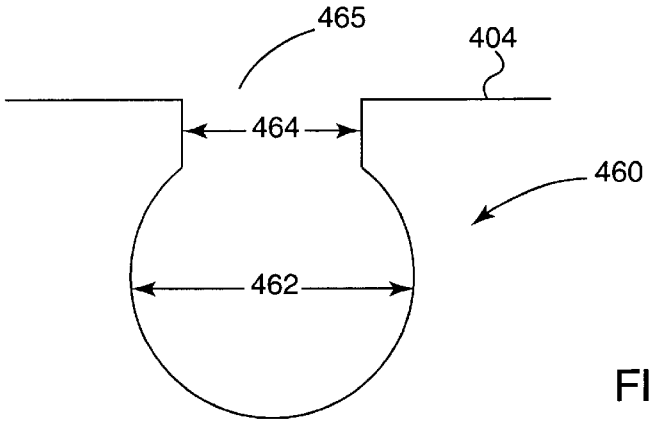

FIG. 4F shows a cross-sectional view of a substantially circular groove shape. The maximum span of this groove is the diameter of the circle 462 which is greater than the span 464 of the surface opening 465. As with the previously described groove shapes with substantially straight sidewalls, groove 460 has undercut groove edges 466, which provide variable flexibility in the polishing pad surface 404 in which the grooves 460 is cut.

As noted above, polishing pad grooves are typically of two different sizes, smaller or "microgrooves" and larger or "macrogrooves." While the present invention is mainly concerned with macrogrooves (slurry distribution grooves), polishing pads according to the present invention may replace either or both these type of grooves with the novel cross-sectional groove shapes described herein.

CMP pads according to the present invention may have the novel groove patterns of the present invention cut in their polishing surfaces by a number of different methods. Typically, these methods make use of machinery presently used to cut conventional grooves in CMP pads, adapted to cut the groove patterns in accordance with the present invention. FIGS. 5A–5D illustrate one preferred embodiment of a method for cutting grooves in a CMP pad in accordance with the present invention. This cutting may be done with, for example, one or more saw blades.

Figure 5A:
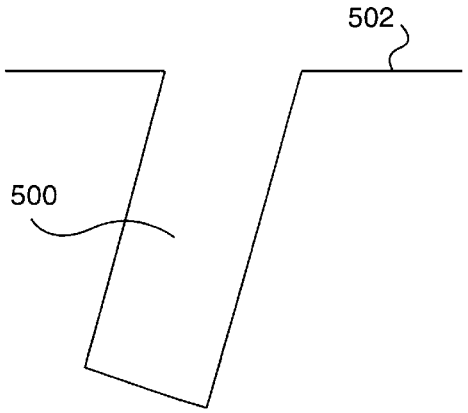
FIGS. 5A–D depict steps in the process of cutting slurry distribution grooves in a chemical mechanical polishing pad according to a preferred embodiment of the present invention.
Figure 5B:
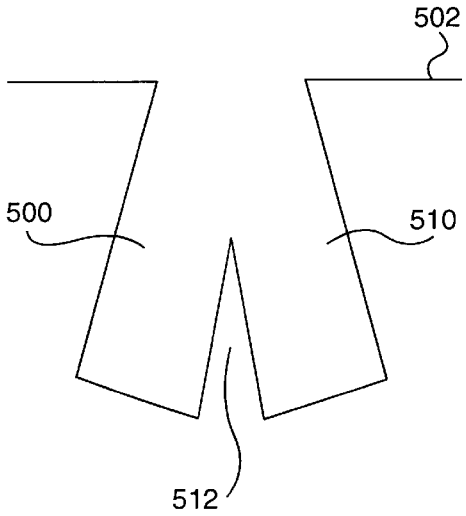
Figure 5C:
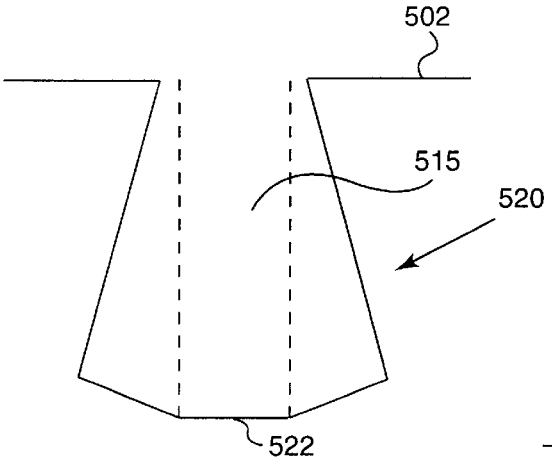

FIG. 5A shows a first cut 500, preferably about 5 to 30 mils wide, more preferably about 10 to 20 mils wide, most preferably about 15 mils wide, made in the polishing surface 502 of a CMP pad using a saw blade angled preferably at about 5 to 80 degrees, more preferably about 10 to 45 degrees, most preferably about 30 degrees positively from normal to the polishing surface. Subsequently, as shown in FIG. 5B, a second cut 510 of about the same width as the first cut 500 is made adjacent to the first cut 500 using a saw blade angled preferably at about 5 to 80 degrees, more preferably about 10 to 45 degrees, most preferably about 30 degrees negatively from normal to the polishing surface. This second cut 510 may be made using the same blade which was used to make cut 500 adjusted to a new angle, or it may be made using a separate blade adjusted to an angle negative from normal to the polishing surface. FIG. 5C shows where a third cut 515 (shown in phantom lines) made normal to the polishing pad surface has removed additional material 512 and created a flat base 522 in the groove 520.

Figure 5D:
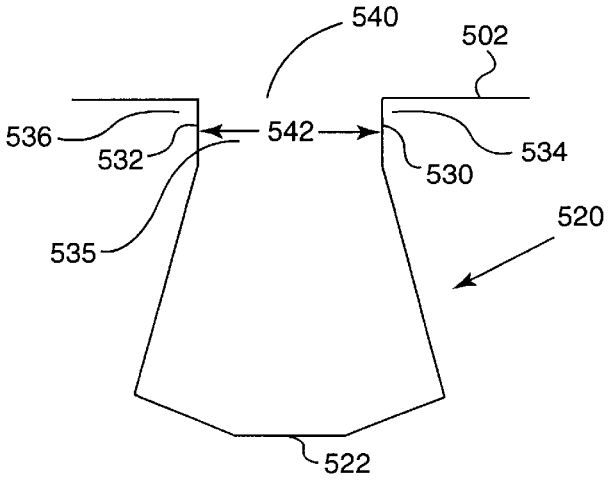

The groove 520 is shown completed in FIG. 5D where an additional cut or cuts have been made normal to the polishing pad surface to form the substantially parallel side walls 530 and 532 of the neck 535, with its edges 534 and 536 adjacent to the groove's surface opening 540. The neck-forming cut is preferably made by a single cut with a blade the width of the surface opening span 542, for example 30 mils. However, the neck may also be formed by two or more separate cuts with narrower blades. In the single blade case, the cut 515 illustrated in FIG. 5C may be made with such a blade so that the material 512 is removed, the base 522 is formed, and the neck is formed all in one cut. Alternatively, cut 515 may be made with a blade having the same width as cuts 500 and 510, and be followed by a single separate shallower cut with a wider blade to form the neck 535.

Figure 6A:
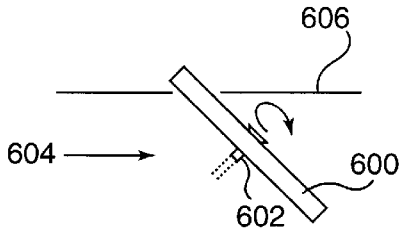
FIGS. 6A–C depict, in simplified form, cross-sectional views of an apparatus for making cuts according to the process of cutting grooves illustrated in FIGS. 5A–C, respectively.
Figure 6B:
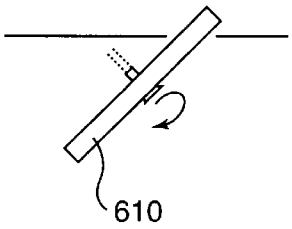
Figure 6C:
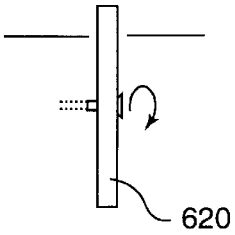

FIGS. 6A–6C show simplified views of blades angled to create the cuts depicted in FIGS. 5A–5C, respectively, to form the groove 520. Referring to FIG. 6A, a blade 600 is mounted in a chuck 602 within a conventional cutting apparatus 604 (not shown in detail), such as are known to those of skill in the art, and rotated at a typical cutting speed for this application. The apparatus 604 has a table 606 upon which a CMP pad (not shown) is placed with its polishing surface down for cutting. The amount of the blade 600 which extends above the table 606 is adjusted to the appropriate depth desired for the groove, for example, 50 mil. The CMP pad polishing surface is then run over the rotating blade 600 in order to make first cut 500. It should be noted that blade 600 may be used alone or, more preferably, may be ganged with other substantially identical blades. In the ganged configuration, many substantially identical adjacent cuts may be made in a CMP pad polishing surface simultaneously.

FIG. 6B shows a blade 610 angled in the opposite direction from normal to the polishing pad surface than blade 600. A blade in this configuration may be used to make the second cut 510 shown in FIG. 5B. The blade 610 may be blade 600 adjusted to a new angle, or may be a separate blade.

FIG. 6C shows a blade 620 in a third configuration, angled normal to the polishing pad surface. The blade 620 may be used to make the cut which removes additional material 512, shown in FIG. 5B to provide the groove 520 shown in FIG. 5C. The blade 620 may be blade 600 adjusted to a new angle, or may be a separate blade. As noted above, if blade 620 is a separate blade it may be wide enough to also cut the groove's neck in a single cut. Otherwise, one or more additional cuts, as described above, may be required to complete the groove 520.

Figure 7:
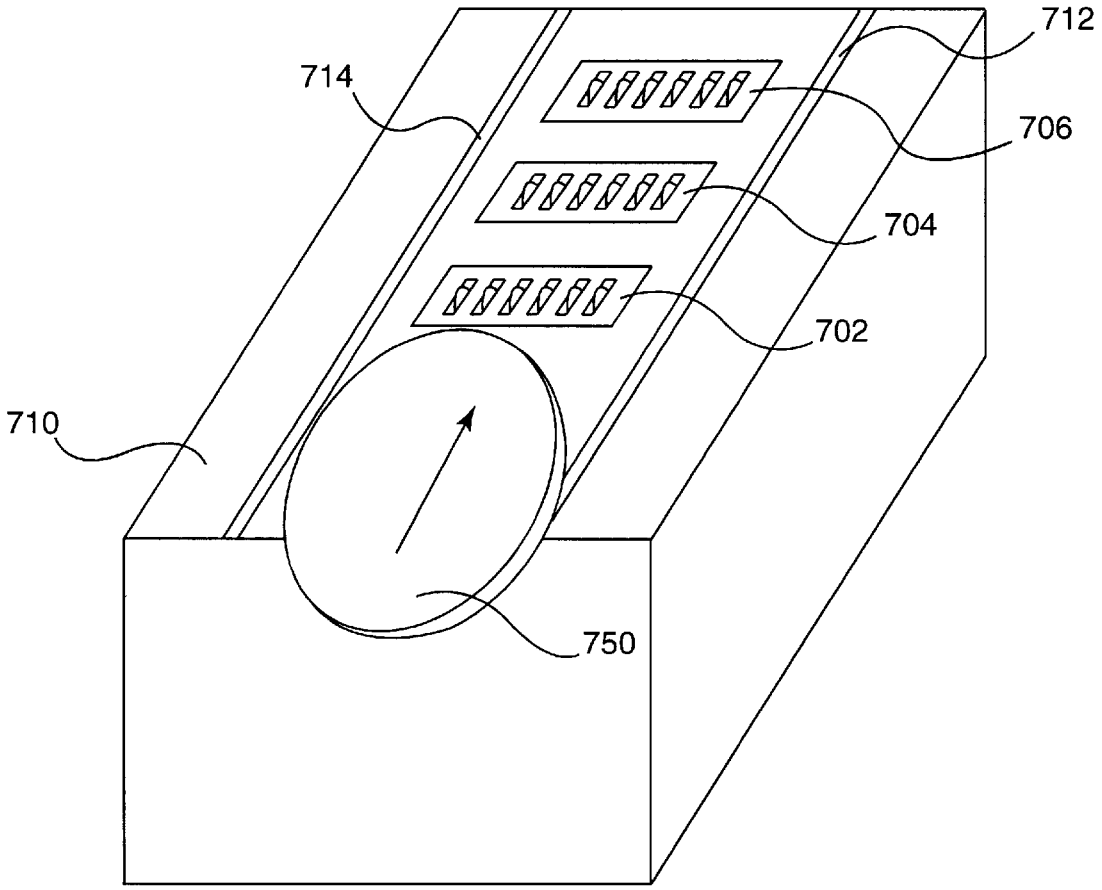
FIG. 7 depicts, in simplified form, a perspective view of an apparatus for cutting grooves in a chemical mechanical polishing pad according to a preferred embodiment of the present invention, which makes use of the process and apparatus illustrated in FIGS. 5A–D and 6A–C.

FIG. 7 shows a simplified example of a cutting apparatus 700 set up with three arrays of ganged blades 702, 704 and 706 for making cuts in a CMP pad 750 in order to form grooves in the pad's polishing surface in accordance with the embodiment of the present invention illustrated in FIGS. 5A–D and 6A–C. FIG. 7 depicts a preferred embodiment whereby a CMP pad 750 is moved across the table 710 of the apparatus 700 guided by guide fences 712 and 714. In this embodiment, the first array of ganged blades 702 cuts a first angled cut, such as cut 500, and the second array of ganged blades 704 cuts a second oppositely, for example, angled cut, such as cut 510. The third array has blades which are normal to the polishing pad surface and wide enough to complete the grooves, including the neck cut. Therefore, the grooves may be completed by a single pass on the cutting apparatus 700. Additional rows of grooves may be cut on the same pad, for example, a grid pattern may be formed by rotating the pad 90 degrees following the first pass on the apparatus and running it over the blades again.

It should be noted that FIGS. 6A–6C and FIG. 7 and the accompanying description presents only one way of cutting grooves in accordance with the present invention. Those of skill in the art will recognize that the groove patterns described herein may be formed in CMP pad polishing surfaces by a variety of different methods using a variety of different cutting machines. For example, the inventive groove cutting method may be implemented using a mill-type cutting apparatus rather than a saw-type cutting apparatus described and illustrated above. It will be obvious to those skill in the art how a conventional mill-type cutting apparatus would be configured to make the equivalent cuts as the saw apparatus described in FIG. 6A–6C.

Figure 8A:
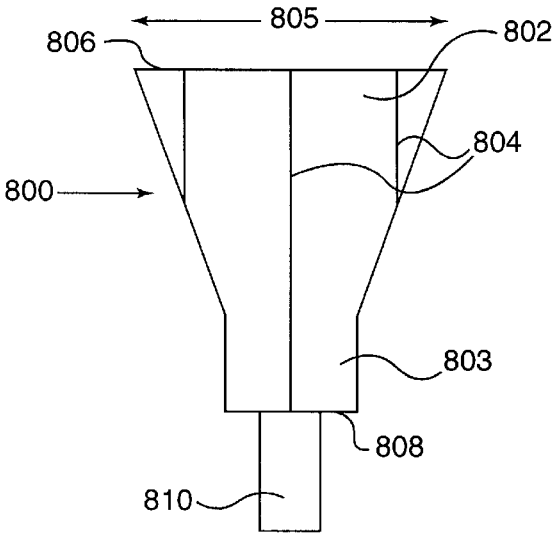
FIGS. 8A and 8B depict cross-sectional and top views, respectively, of a cutting device according to a preferred embodiment of the present invention.
Figure 8B:
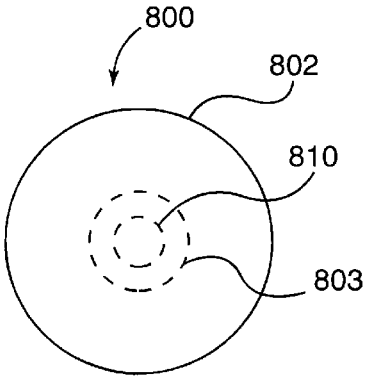
Figure 9:
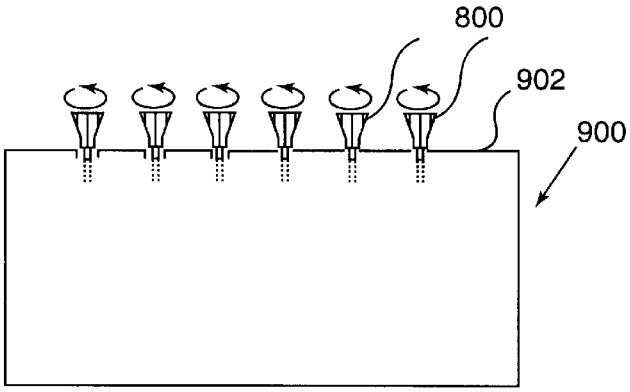
FIG. 9 depicts, in simplified form, an apparatus which makes use of the cutting device depicted in FIGS. 8A and 8B for cutting grooves in a chemical mechanical polishing pad in accordance with a preferred embodiment of the present invention.

A further embodiment of the present invention is illustrated in FIGS. 8A, 8B, and 9. As an alternative to forming grooves in a CMP pad polishing surface by making a plurality of cuts with a conventional cutting tool, a novel cutting tool capable of forming grooves in CMP polishing pads according to the present invention with a single cut is provided. As shown in FIG. 8A, the cutting tool of the present invention 800 includes a cutting head 802 having the profile of a desired groove shape, including a portion 803 for cutting the groove's neck. The cutting head bears a plurality of blades 804. In the particular embodiment shown in FIG. 8A, the maximum span of the cutting head 805 is at its top 806. At its base 808, the cutting head is attached to shank 810 for connection to a cutting machine (not shown).

The cutting device may be made of any suitable material, such as high-carbon steel, or other metal alloy or ceramic materials. Such materials are well-known to those with skill in the art. Similarly, the blades 804 may be made of any materials suitable for cutting conventional polishing pad materials. The blades may be made attached to the cutting head by methods known to those of skill in the art including by means of adhesives and/or welds. The blades may also be formed directly on the cutting head.

FIG. 8B depicts a top view of the cutting device 800 of the present invention. This view shows the circular profile of the cutting device in its axis of rotation. In use, the shank 810 of the device 800 will be mounted in a chuck (not shown) of a router-type cutting apparatus, such as shown in greatly simplified form in FIG. 9. As with the saw- and mill-type blade configurations discussed above, the cutting device of the present invention may be used on its own or ganged with other substantially identical devices in order to cut grooves in CMP pads according to the present invention.

FIG. 9 is a simplified depiction of a router-type cutting apparatus 900 fitted with a plurality of cutting devices such as those illustrated in FIGS. 8A and 8B. In order to cut grooves according to the present invention, a CMP pad is moved along the router's table 902 and into contact with the rotating cutting devices 800. Once the CMP pad polishing surface has been run over the cutting blades, the grooves will be completed with the necessity of making any additional cuts. Thus, the cutting device of the present invention provides a significant advantage in forming grooves in accordance with the present invention by eliminating the need for multiple cuts to form the grooves.

Of course, the cutting device of the present invention is not limited to any one particular shape, but may be shaped to have the profile of any desired groove shape. For example, cutting devices in accordance with the present invention may be made with a profile for cutting groove shapes such as those illustrated in FIGS. 4B, 4C, and 4F.

Figure 10:
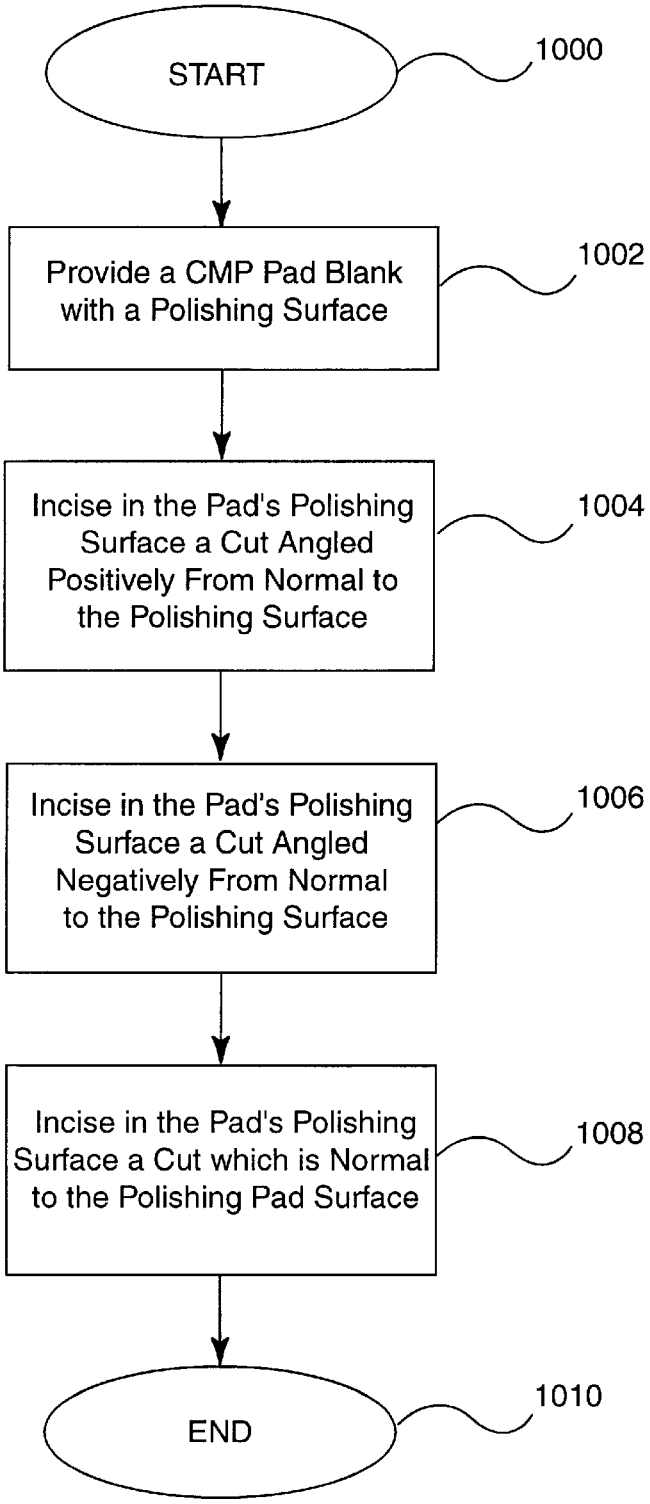
FIG. 10 is a flow chart depicting the steps of a method of cutting grooves in a chemical mechanical polishing pad in accordance with a preferred embodiment of the present invention.

FIG. 10 is a process flow diagram of one preferred method for forming grooves in a CMP pad in accordance with the present invention. This process flow is provided for that method described with relation to FIGS. 5A–D, above. The process starts at 1000 and in a step 1002 a CMP pad blank with a polishing surface is provided for groove cutting. At a step 1004, the pad's polishing surface is incised with a cut angled positively from normal to the polishing surface. Than, at a step 1006, the pad's polishing surface is incised with a cut angled negatively from normal to the polishing surface. Next, at step 1008 the pad's polishing surface is incised with a third cut, wider than the first two, which is normal to the polishing pad surface in order to complete the groove. The process is completed at 1010.

Although the foregoing invention has been described in some detail for purposes of clarity of understanding, it will be apparent that certain changes and modifications may be practiced within the scope of the appended claims. For example, while the specification has described several grooves shapes and methods and apparatuses for forming grooves in CMP pads, other shapes, methods and apparatuses which will be understood by those of skill in the art from the present disclosure to be within the spirit of the present invention may equally be used. Therefore, the present embodiments are to be considered as illustrative and not restrictive, and the invention is not to be limited to the details given herein, but may be modified within the scope of the appended claims.

What is claimed is:

1. A chemical mechanical polishing pad, comprising:

a polishing surface;

a groove in said polishing surface, said groove having a surface opening and a base, and said groove having a sub-surface cross-sectional span greater than a surface opening span.

2. The chemical mechanical polishing pad of claim 1 wherein said groove comprises a neck region adjacent to said surface opening, said neck region having substantially parallel side walls.

3. The chemical mechanical polishing pad of claim 2 wherein a cross-sectional span of said base is greater than said surface opening span.

4. The chemical mechanical polishing pad of claim 3, wherein groove side walls diverge from said neck region to said base.

5. The chemical mechanical polishing pad of claim 2, wherein said groove has a substantially triangular cross-sectional profile.

6. The chemical mechanical polishing pad of claim 2 wherein said groove has an at least partially curved cross-sectional profile.

7. The chemical mechanical polishing pad of claim 2, wherein said groove has a surface opening at the pad's polishing surface of about 5 to 60 mils, the maximum sub-surface span of the groove is about 10 to 100 mils, and the depth of the groove is about 10 to 60 mils.

8. The chemical mechanical polishing pad of claim 7, wherein the neck height is about 5 to 20 mils.

9. The chemical mechanical polishing pad of claim 7, wherein said groove has a surface opening at the pad's polishing surface of about 30 to 50 mils, the depth of the groove is about 30 to 50 mils, and the maximum sub-surface span of groove is about 20 to 80 mils.

10. The chemical mechanical polishing pad of claim 9, wherein the neck height is about 5 to 20 mils.

11. The chemical mechanical polishing pad of claim 9, wherein said groove has a surface opening at the pad's polishing surface of about 40 mils, the depth of the groove is about 40 mils, and the maximum sub-surface span of groove is about 60 mils.

12. The chemical mechanical polishing pad of claim 11, wherein the neck height is about 5 to 20 mils.

* * * * *